US007121208B2

(12) United States Patent
Gateaud et al.

(10) Patent No.: US 7,121,208 B2
(45) Date of Patent: Oct. 17, 2006

(54) METHOD OF SETTING OPTIMIZED PRE-INKING PRIOR TO THE START OF PRINTING THE CURRENT PRINT JOB

(75) Inventors: Caroline Gateaud, Leimen (DE); Martin Mayer, Ladenburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/225,542

(22) Filed: Sep. 13, 2005

(65) Prior Publication Data

US 2006/0054044 A1 Mar. 16, 2006

(30) Foreign Application Priority Data

Sep. 13, 2004 (DE) ..... 10 2004 044 125

(51) Int. Cl.
*B41F 1/54* (2006.01)
*B41F 31/02* (2006.01)

(52) U.S. Cl. ..... 101/483; 101/365

(58) Field of Classification Search ..... 101/483, 101/365, 211, 181, 350.1, 183, 485; 347/9, 347/14, 17; 358/1.9, 1.15, 1.1, 504
See application file for complete search history.

(56) References Cited

U.S. PATENT DOCUMENTS

| | | | | |
|---|---|---|---|---|
| 3,835,777 | A * | 9/1974 | Krygeris | 101/350.4 |
| 4,524,692 | A * | 6/1985 | Rodvelt | 101/350.1 |
| 4,656,941 | A * | 4/1987 | Brovman | 101/483 |
| 5,070,784 | A * | 12/1991 | Nishida et al. | 101/365 |
| 5,548,308 | A * | 8/1996 | Nagatomo et al. | 347/9 |
| 5,625,758 | A | 4/1997 | Schneider et al. | 358/1.15 |
| 6,373,964 | B1 * | 4/2002 | Geissler et al. | 382/112 |
| 6,450,097 | B1 * | 9/2002 | Kistler et al. | 101/483 |
| 6,580,524 | B1 * | 6/2003 | Weichmann et al. | 358/1.9 |
| 6,889,606 | B1 * | 5/2005 | Emura et al. | 101/365 |
| 2001/0003955 | A1 * | 6/2001 | Mayer et al. | 101/183 |
| 2003/0213388 | A1 | 11/2003 | Mayer et al. | 101/365 |

FOREIGN PATENT DOCUMENTS

| | | | |
|---|---|---|---|
| DE | 43 28 026 | A1 | 3/1995 |
| DE | 198 44 495 | A1 | 4/2000 |
| DE | 100 32 765 | A1 | 4/2001 |
| DE | 100 17 800 | A1 | 6/2001 |
| DE | 103 12 998 | A1 | 10/2003 |
| EP | 0 495 563 | A2 | 7/1992 |

* cited by examiner

*Primary Examiner*—Daniel J. Colilla
*Assistant Examiner*—Wasseem H. Hamdan
(74) *Attorney, Agent, or Firm*—Laurence A. Greenberg; Werner H. Stemer; Ralph E. Locher

(57) ABSTRACT

A method for setting optimal pre-inking before the start of printing in an inking unit in a press having at least one printing unit. The settings for the pre-inking are determined by an electronic control device belonging to the press. At least one standard characteristic curve for controlling the pre-inking before the start of printing is stored in the electronic control device of the press for at least one combination of parameters of a print job. On the basis of this stored standard characteristic curve, a current characteristic curve is calculated as a function of the job data of a current print job. Finally, the the pre-inking before the start of printing the current print job is controlled by using this current characteristic curve.

8 Claims, 3 Drawing Sheets

METHOD OF SETTING OPTIMIZED PRE-INKING PRIOR TO THE START OF PRINTING THE CURRENT PRINT JOB

BACKGROUND OF THE INVENTION

Field of the Invention

The present invention relates to a method for setting optimal pre-inking before the start of printing in an inking unit in a press with at least one printing unit. The settings for the pre-inking are determined by an electronic control device belonging to the press.

The printing units in offset presses are equipped with inking units that supply the plate cylinder having the printing plate with the ink necessary for the printing. When the press has reached a steady operating state, that is to say the press is in steady-state continuous printing, the press is operated with a quite specific, constant setting of the respective inking unit. However, before the press reaches this steady state, that is to say in the start-up phase before the start of printing or after changing a print job, this steady state first has to be set in the inking unit of the individual printing units. In order to be able to start printing, the quantity of ink required for continuous printing has to be introduced into the inking unit by means of pre-inking before the start of printing. The pre-inking is in this case carried out with a specific ink stripe width, it normally being possible for the duration of the pre-inking to be selected by the user, that is to say ink runs into the inking unit as long as the operator predefines it. For this purpose, the inking zone openings of the inking units in the individual printing units have to be positioned appropriately, either manually by the operator or by an electronic controller belonging to the press. The quantity of ink depends highly on the area coverage, so that the positioning of the inking zone opening for the pre-inking is carried out by means of a characteristic curve as a function of the area coverage. This characteristic curve is fixed at present and is not adapted to the start-up duration, for which reason an increase in the pre-inking time leads to increasing over-inking of regions with a low ink uptake. Since the pre-inking characteristic curve is defined, the current pre-inking leads to severe over-inking or under-inking, depending on whether the pre-inking time is too long or too short, since different combinations of printed inks, printing material or desired color require fundamentally different pre-inking parameters. In the case of low area coverages, because of the time behavior of the inking unit, it takes a particularly long time until over-inking or under-inking has been dissipated, which means that a great deal of waste accumulates with the current pre-inking.

German published patent application DE 103 12 998 A1 and its counterpart patent application publication US 2003/0213388 A1 describe a method which attempts to reduce this waste, in that, in particular before starting to print a print job, the settings are optimized during the pre-inking by the data from the print job being compared with that of earlier print jobs and the suitable data for the current pre-inking then being calculated from the data stored for the old print jobs. An attempt is therefore made to profit from the experience from preceding print jobs with the ink presetting during pre-inking and data stored for this purpose. The disadvantage with this procedure is that, because of the many parameters on which a print job is based, one print job barely corresponds to a further print job. This means that the settings for the pre-inking of the current print job can be calculated only inadequately from the old data.

SUMMARY OF THE INVENTION

It is accordingly an object of the invention to provide a method of adjusting optimal pre-inking prior to the start of a print job which overcomes the above-mentioned disadvantages of the heretofore-known devices and methods of this general type and which is able to take into account the current job data with regard to the composition of printing material, printed ink and color.

With the foregoing and other objects in view there is provided, in accordance with the invention, a method of setting optimal pre-inking in an inking unit prior to a start of printing in a printing unit of a printing press, the press having at least one printing unit and an electronic control device for determining the settings for the pre-inking, the method which comprises:

storing in the electronic control device at least one standard characteristic curve for controlling the pre-inking prior to the start of printing for at least one combination of parameters of a given print job;

calculating, on a basis of the standard characteristic curve stored in the electronic control device, a current characteristic curve as a function of job data relating to a current print job; and controlling the pre-inking prior to the start of printing the current print job by referring to the current characteristic curve.

The method according to the invention for setting the optimum pre-inking before the start of printing can in principle be used in all offset presses in which parameters such as the inking zone opening are calculated by a computer belonging to the press, such as the machine control system. Such a machine can also perform the optimum setting of the pre-inking automatically. In the computer belonging to the press, in this case there is stored at least one standard characteristic curve for optimum pre-inking, which applies to a specific standard print job and is designated a standard pre-inking profile. Since, in the case of each print job, many parameters such as printed inks, printing material and color change, this standard pre-inking profile can be used optimally only for a quite specific print job. The optimal characteristic curve for the pre-inking of all other print jobs is derived from the stored standard characteristic curve. The calculation of the current characteristic curve in relation to the optimal pre-inking is in this case substantially based on the analysis and the knowledge of the inking zone opening of the individual inking units positioned for continuous printing, that is to say the ink presetting characteristic curve used for the continuous printing is used in order to draw conclusions about the matching optimal pre-inking profile. The ink presetting characteristic curve for the continuous printing of the current print job, that is to say the steady state of the press, contains all the important job parameters such as printing material, inks and color, as well as the environmental conditions such as atmospheric humidity and room temperature. In addition to the installed standard characteristic curve for the optimized pre-inking for the standard print job, the matching standard ink presetting characteristic curve for continuous printing is additionally stored in the machine.

Therefore, the inking zone opening of the standard print job positioned for continuous printing can be related to the inking zone opening of the current print job positioned for continuous printing, and there therefore also exists a relationship between the stored characteristic curve of the standard print job for optimum pre-inking and the characteristic curve for the optimized pre-inking of the current print job. In one implementation, in this case the current pre-inking profile is set in relation to the standard pre-inking profile in accordance with the ratio between the inking zone opening of the standard job positioned for continuous printing and the inking zone opening of the current job positioned for continuous printing. However, other complicated conversion modules can also be used.

In a first refinement of the invention, provision is made for the current job data to contain the printing material, the printed ink or the color. As many properties as possible of the current print job should be known, so that the current ink presetting characteristic curve for continuous printing is available as optimally as possible and the matching inking zone openings can be calculated. In principle, however, it is also possible to incorporate further data in the calculation, such as ambient temperature or atmospheric humidity, etc. The more parameters of the current print job are known, the more accurate will the results of the calculation be. Accordingly, the derivation of the setting of the inking zone openings for the pre-inking of the current job can then be carried out more precisely. In this way, the influence of these parameters can be taken into account when positioning the inking zone openings for continuous printing.

In accordance with an additional feature of the invention, the number of ductor cycles of the inking unit remains constant during pre-inking. In this case, the pre-inking before the start of printing is controlled only via the current pre-inking profile; the number of ductor cycles in the inking unit remains constant.

Furthermore, provision is made for the current pre-inking profile, that is to say the current inking zone opening, to remain constant during the pre-inking period. The data for setting the current pre-inking profile, determined by using the inking zone opening for the current job set for continuous printing, leads to the calculated pre-inking profile being able to remain unchanged during the entire duration of the pre-inking before the start of printing. This simplifies the determination of the correct pre-inking profile and the operation of the pre-inking before the start of printing. However, it is also possible to use pre-inking functions which change the pre-inking profile over the period of the pre-inking. Therefore, in the event of complicated conditions, the pre-inking could be optimized further.

If the pre-inking period during pre-inking before the start of printing is constant, the operator does not need to enter any more parameters, so that the operator merely has to predefine the color for the printed sheets following pre-inking. The color desired by the printer is then the only entry required in order to be able to carry out the pre-inking optimally.

Other features which are considered as characteristic for the invention are set forth in the appended claims.

Although the invention is illustrated and described herein as embodied in a method for optimized pre-inking before the start of printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 3:
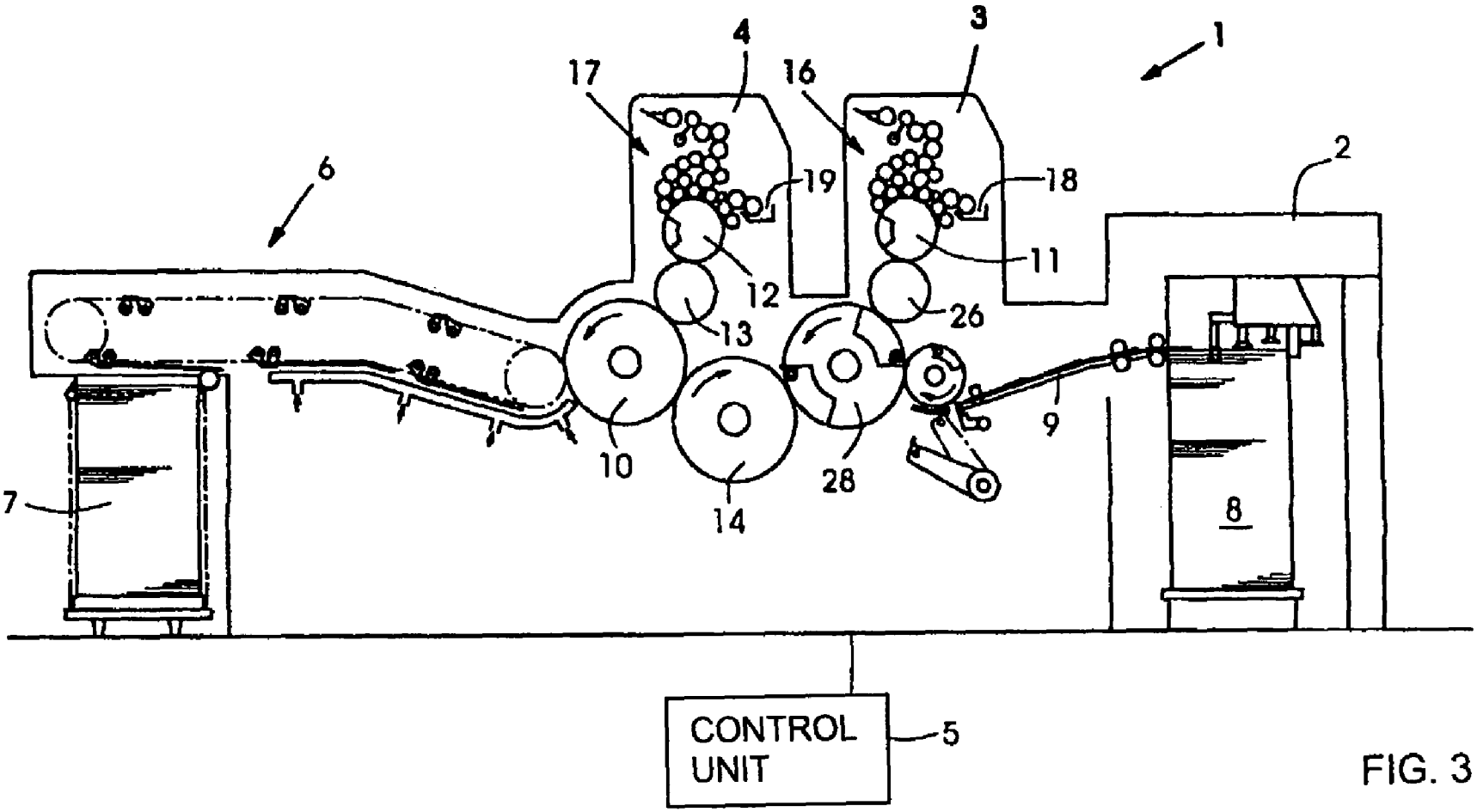
FIG. 3 is a diagram illustrating a sheet-fed printing press that is suitable for implementing the method according to the invention.

Referring now to the figures of the drawing in detail and first, particularly, to FIG. 3 thereof, there is shown a sheet-fed press 1 with two printing units 3, 4, each having an inking unit 16, 17. Upstream of the printing units 3, 4 in the sheet running direction there is provided a feeder 2, which delivers sheets from a feed pile 8 via a suction tape table 9 into the first printing unit 3 of the press 1. In the first printing unit 3, the sheets are printed with a first color separation between the blanket cylinder 26 and an impression cylinder 28 and then supplied to the second printing unit 4 via a transport cylinder 14. In the second printing unit 4, the sheets are then printed with a second color separation between impression cylinder 10 and blanket cylinder 13. At the outlet from the second printing unit 4, the printed sheets are conveyed by the delivery 6 to a delivery stack 7 and can be supplied to further print processing.

In the two printing units 3, 4, the printing ink is in each case distributed uniformly over the entire printing width from the ink containers of the inking units 16, 17 by means of a plurality of inking rolls and additionally dampened by dampening units 18, 19. The ink in the respective printing units 3, 4 is distributed to the plate cylinders 11, 12 with the printing plates clamped thereon, via the ink applicator rolls applied to the plate cylinder 11, 12. Depending on whether the press 1 is in the continuous printing state, that is to say in the steady state, or whether the press 1 is still in the start-up phase, the inking zones in the inking units 16, 17 have to be positioned differently. The thickness of the ink application to the plate cylinders 11, 12 can in each case be regulated zone by zone by the setting of the inking zones. At the start of a print job, first of all by means of a first pre-inking, an exactly metered quantity of ink has to be delivered to the inking units 16, 17 in order to be able to start with the initial printing if the inking unit has previously been washed. The entire press 1 is in this case monitored by an electronic control device 5, according to FIG. 3, so the operator merely has to enter all the job data into the controller 5 and the machine then makes the appropriate settings for the print job. By means of the control device 5, it is also possible to adjust the inking zone openings of the inking units 16, 17 by motor and in this way to set them in accordance with the data passed on by the control device 5. Therefore, automatic setting of the inking zone openings in the inking units 16, 17 for the pre-inking before the start of printing by the control device 5 by using the job data entered there for the current print job is also possible. For this purpose, by using the print job data from the current print job, the optimum setting of the pre-inking before the start of printing is calculated in the control device 5, and the setting calculated from this for the inking zone openings is passed on to the actuating motors of the inking units 16, 17. In another refinement, however, it is also possible for the inking zone openings merely to be calculated by the control device 5 or in another computer. The operating personnel enter calculated setting values for the inking zone openings into the inking units 16, 17 by means of direct entry of these values into the controller of the inking units 16, 17 or set the inking zone openings by hand.

Figure 1:
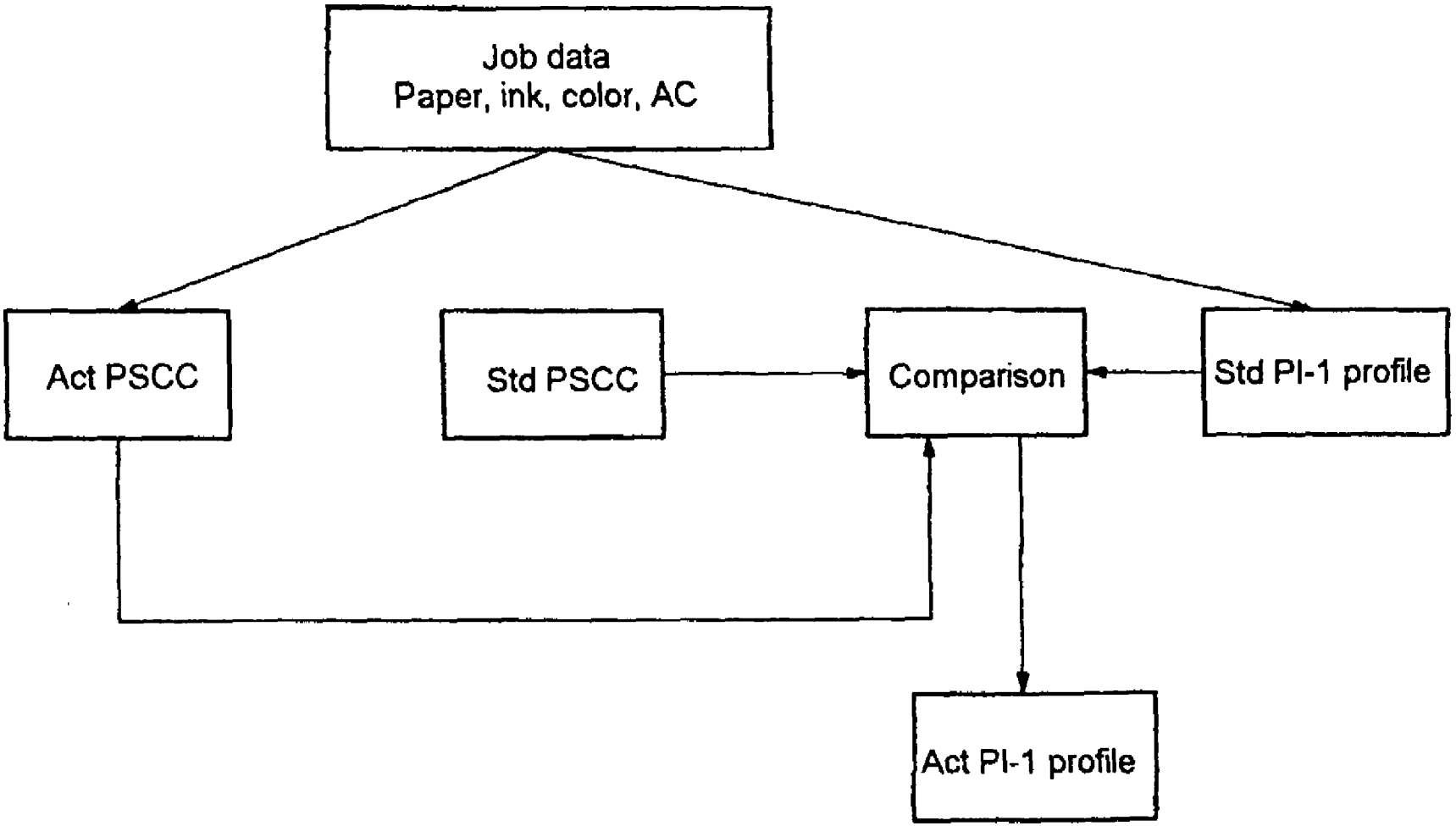
FIG. 1 is a diagram relating to the basic progress of the calculation method for presetting the inking zones or the pre-inking profile before the start of printing.

FIG. 1 shows schematically the procedure when determining the optimal setting of the inking zone openings for the pre-inking before the start of printing. The method according to the invention is based on the fact that, for at least one standard print job with associated parameters such as printing material, for example paper composition, ink, color and the area coverage, but also room temperature, an optimal standard characteristic curve Std PI-1 profile for the inking zone opening during pre-inking before the start of printing is determined, for example experimentally. This standard characteristic curve Std PI-1 profile, of course, is optimal only for precisely these standard printing conditions, that is to say this standard characteristic curve must be adapted appropriately for all other printing conditions. Furthermore, a standard presetting characteristic curve Std PSCC for the inking zone openings during printing operation for the same printing conditions as the standard pre-inking characteristic curve Std PI-1 profile is installed in the control device 5. In addition, the current presetting characteristic curve Act PSCC for the continuous printing of a current print job is additionally known and takes into account the current job data such as paper, ink, color, area coverage AC and the current printing conditions. The current presetting characteristic curve Act PSCC can be obtained from the prepress stage by the control device 5, or it is set up separately from the job data and entered into the machine control system 5 by hand.

By means of simple ratio formation of the current presetting characteristic curve Act PSCC divided by the standard presetting characteristic curve Std PSCC multiplied by the standard pre-inking profile Std PI-1 profile, the current pre-inking profile Act PI-1 profile can then be calculated. However, apart from the simple ratio calculation applied here, another conversion module is in principle also possible.

Figure 2:
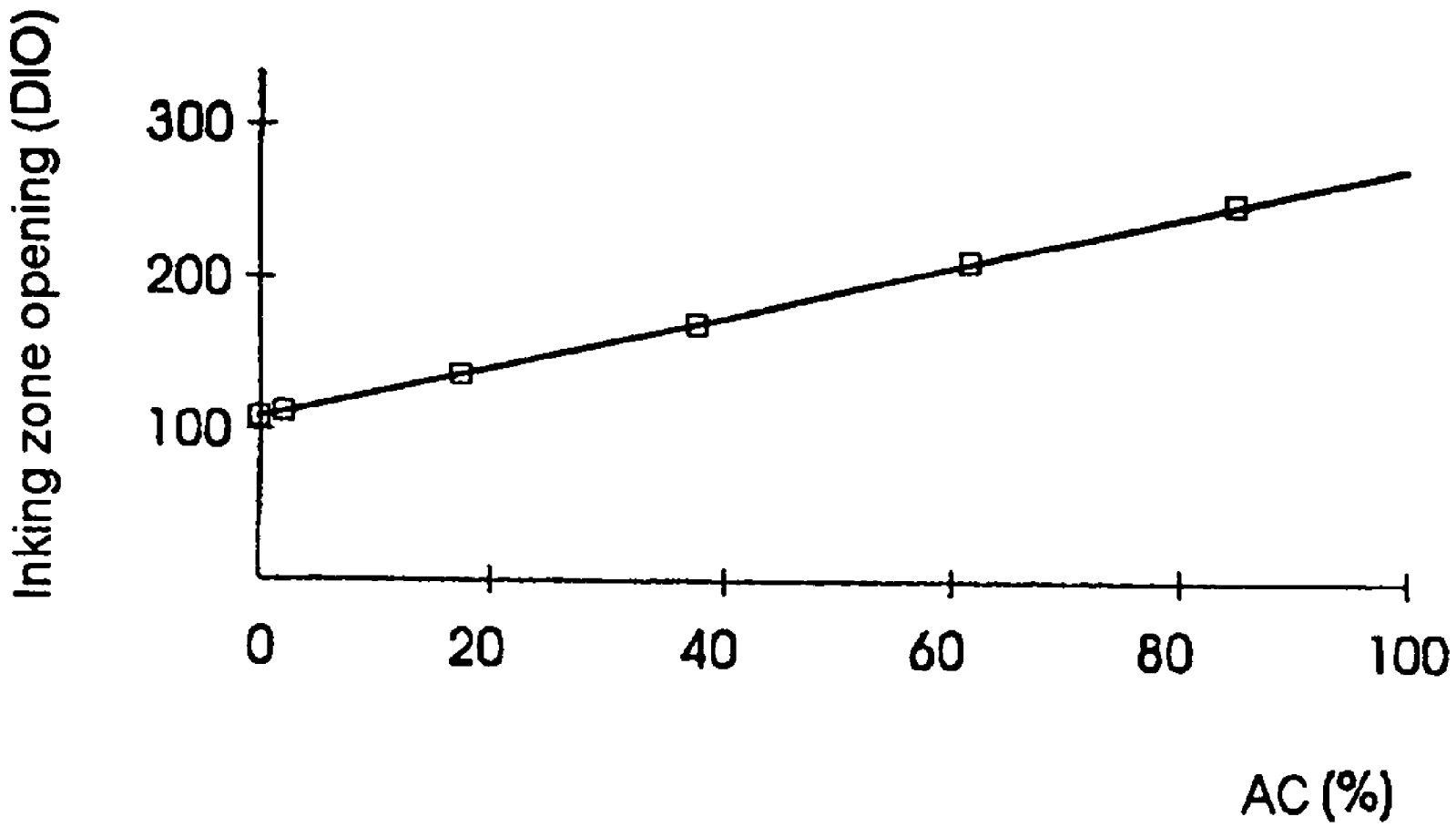
FIG. 2 shows, by way of example, a pre-inking profile for a specific standard print job.

FIG. 2 shows, by way of example, a standard characteristic curve for a standard pre-inking profile Std PI-1 profile, the area coverage AC in % being plotted on the x axis and the pre-inking inking zone opening in diode units DIO being plotted on the y axis. Diode units DIO designate the number of diodes lighting up on a display in order to display the inking zone opening. This standard pre-inking profile Std PI-1 profile for the pre-inking before the start of printing is converted into the current pre-inking profile Act PI-1 profile by means of the method outlined, with a knowledge of the job data from the current print job. If the current print job is started with the current pre-inking profile Act PI-1 profile, then the waste can also be reduced for the current print job in a manner similar to the standard print job, since over-inking or under-inking occur for a considerably shorter time as compared with conventional procedures. For the purpose of further simplification, during pre-inking before the start of printing, the set pre-inking profile Act PI-1 profile can remain unchanged during the pre-inking. In addition, the pre-inking duration during the pre-inking before the start of printing does not need to be changed either, since the pre-inking is then controlled only via the calculated current pre-inking profile Act PI-1 profile. In addition, the number of ductor cycles during the pre-inking can remain constant. The operator no longer needs to predefine any parameters such as pre-inking duration and pre-inking profile to the control device 5, but can simply enter his print job data and the desired color into the control device 5, which then calculates the current pre-inking profile Act PI-1 profile for the current print job appropriately. In addition to avoiding waste, this also makes the operation of the pre-inking before the start of printing easier. When the pre-inking has been concluded, the inking zone openings are positioned as is needed for the current continuous printing. The change in the inking zones for the continuous printing can either be initiated by the operator himself or is done automatically via the control system belonging to the press, so that the operator does not have to switch over the inking zone openings from pre-inking to continuous printing himself. In this case, when the time for pre-inking has elapsed, the inking zone openings are automatically repositioned for continuous printing.

This application claims the priority, under 35 U.S.C. § 119, of German patent application No. 10 2004 044 125.1, filed Sep. 13, 2004; the disclosure of the prior application is herewith incorporated by reference in its entirety.

We claim:

1. A method of setting optimal pre-inking in an inking unit prior to a start of printing in a printing unit of a printing press, the press having at least one printing unit and an electronic control device for determining the settings for the pre-inking, the method which comprises:

storing in the electronic control device at least one standard characteristic curve for controlling the pre-inking prior to the start of printing for at least one combination of parameters of a given print job;

calculating, on a basis of the standard characteristic curve stored in the electronic control device, a current characteristic curve as a function of job data relating to a current print job; and controlling the pre-inking prior to the start of printing the current print job by referring to the current characteristic curve.

2. The method according to claim 1, which comprises taking job data from a current print job into account when calculating the current characteristic curve for the pre-inking before the start of printing, by deriving a current presetting characteristic curve from the job data, comparing with a standard presetting characteristic curve for the printing stored for at least one combination of parameters of a standard print job, and comparing in a relationship with the standard characteristic curve for the pre-inking before the start of printing stored for at least the same combination of parameters of the standard print job.

3. The method according to claim 2, which comprises relating the current presetting characteristic curve to the standard presetting characteristic curve and multiplying by the standard characteristic curve for the pre-inking before the start of printing in order to obtain the current characteristic curve for the pre-inking before the start of printing.

4. The method according to claim 1, wherein a number of ductor cycles of the inking unit remains constant during the pre-inking.

5. The method according to claim 1, wherein the inking unit has inking zones and the method further comprises keeping a current inking zone opening constant during a pre-inking period.

6. The method according to claim 1, wherein the inking unit has inking zones and the method further comprises making an inking zone setting for the pre-inking before the start of printing as a function of an inking zone setting for a continuous printing of the current print job.

7. The method according to claim 6, which comprises controlling an adjustment of the inking zones in the inking unit during pre-inking with the electronic control device of the press.

8. The method according to claim 1, wherein the inking unit has inking zones and the method comprises positioning the inking zones as required for continuous printing after pre-inking has been carried out.

* * * * *

UNITED STATES PATENT AND TRADEMARK OFFICE

CERTIFICATE OF CORRECTION

PATENT NO. : 7,121,208 B2
APPLICATION NO. : 11/225542
DATED : October 17, 2006
INVENTOR(S) : Caroline Gateaud et al.

It is certified that error appears in the above-identified patent and that said Letters Patent is hereby corrected as shown below:

TITLE PAGE,
Item (75),

Inventor: "Leimen (DE);" should read -- Sarreguemines (FR); --

Signed and Sealed this

Twenty-third Day of January, 2007

JON W. DUDAS
*Director of the United States Patent and Trademark Office*